US005695419A

United States Patent [19]

Haringa

[11] Patent Number: 5,695,419

[45] Date of Patent: Dec. 9, 1997

[54] BATTING PRACTICE ATTACHMENT FOR BASEBALL BATS

[76] Inventor: Kenneth R. Haringa, P.O. Box 7200-520, Costa Mesa, Calif. 92628

[21] Appl. No.: 781,398

[22] Filed: Jan. 10, 1997

Related U.S. Application Data

[63] Continuation of Ser. No. 458,857, Jun. 2, 1995, Pat. No. 5,605,325, which is a continuation of Ser. No. 100,618, Jul. 30, 1993, abandoned.

[51] Int. Cl.[6] ..... A63B 59/06

[52] U.S. Cl. ..... 473/564

[58] Field of Search ..... 473/168, 199, 473/564, 566, 422, 565, 567

[56] References Cited

U.S. PATENT DOCUMENTS

| | | | |
|---|---|---|---|
| D. 156,963 | 1/1950 | Johnson . | |
| 310,248 | 1/1885 | Brown . | |
| 771,247 | 10/1904 | Hillrich . | |
| 780,244 | 1/1905 | Truesdell . | |
| 805,132 | 11/1905 | Gubbins . | |
| 1,603,923 | 10/1926 | Powers . | |
| 1,927,083 | 9/1933 | Davis . | |
| 3,618,945 | 11/1971 | Lyndhurst . | |
| 3,623,724 | 11/1971 | Lande . | |
| 3,809,090 | 5/1974 | Pevlacs . | |
| 3,833,217 | 9/1974 | Greaney . | |
| 3,940,131 | 2/1976 | St. Claire, Jr. . | |
| 3,944,225 | 3/1976 | Greaney . | |
| 3,955,816 | 5/1976 | Bratt . | |
| 4,014,542 | 3/1977 | Tanikawa . | |
| 4,569,521 | 2/1986 | Mueller . | |
| 4,644,630 | 2/1987 | Blum | 473/567 |
| 4,657,251 | 4/1987 | Larsen . | |
| 4,762,320 | 8/1988 | Larsen . | |
| 4,817,593 | 4/1989 | Taller . | |
| 4,989,865 | 2/1991 | Plevier . | |
| 5,024,436 | 6/1991 | Vento . | |
| 5,050,877 | 9/1991 | Wales . | |
| 5,451,047 | 9/1995 | Liu | 473/564 |
| 5,605,325 | 2/1997 | Haringa . | |

FOREIGN PATENT DOCUMENTS

| | | |
|---|---|---|
| 0023877 | 1/1991 | Japan . |
| 547946 | 9/1942 | United Kingdom . |

*Primary Examiner*—Theatrice Brown
*Attorney, Agent, or Firm*—Knobbe, Martens, Olson & Bear, LLP

[57] ABSTRACT

An attachment for bats designed principally for use in batting practice, comprising a thin wall tube of rubber-like material of length approximating the length of the contact zone of the bat. In one embodiment, the tube is closed at one end with the closed end covering the end of the bat. An edge rim of greater thickness is present in one embodiment to protect the end from tearing and in other embodiments, raised patterns are present on the external surface of the tube.

1 Claim, 2 Drawing Sheets

BATTING PRACTICE ATTACHMENT FOR BASEBALL BATS

This application is a continuation of U.S. patent application Ser. No. 08/458,857, filed Jun. 2, 1995, (U.S. Pat. No. 5,605,325), which was a continuation of U.S. patent application Ser. No. 08/100,618, filed Jul. 30, 1993, now abandoned.

FIELD OF THE INVENTION

This invention relates to the field of baseball training devices and particularly the bats used in practice.

BACKGROUND OF THE INVENTION

In the field of baseball, the time spent in batting practice usually is far greater than that actually spent during a game. The necessity of batting practice is recognized by batting coaches from little league through amateur, recreational, varsity college and all stages of professional play. The need for batting practice has grown to the extent that a number of batting cages have developed including pitching machines as well as live pitchers to provide the batter with a series of pitches, as many as 600 per hour, to sharpen the batter's skills. Batting practice can take a tremendous toll on the bats used. Not only is there danger of wooden bats breaking, but they develop what is known as chipping and scuffing, as well as cracking. Metal bats produce loud sounds in a batting cage with a number of batters simultaneously practicing. Metal bats, in addition to the sound often suffer dents that make the bat unattractive, undesirable and often useless.

The batting coach often relies on the sound of the bats striking the ball as an indication of quality of the hit. The reliance on sound can be misleading, however, since often batters will try to cut the ball, that is, a downward swing to get back spin and loft. This adds particularly to the tendency to chip wooden bats and raising the grain to the extent that you can actually peel splinters off the bat.

I am a professional ball player and have instructed in batting employing batting cages for a number of years and have recognized the above problems. It occurred to me that it would be desirable to minimize the likelihood of chipping, splitting, cracking or denting of bats if it would be possible to have some kind of a protective cover that did not interfere with the batting training.

I explored the prior art and found that most of the additions to the contact zone or head region of the bat are in the form of temporary added weights of one form or another. These are often called "donuts" because of their shape and used primarily for swinging the bat in preparation for the time at the plate. They are substitute for the time honored practice of swinging two bats in preparation for one's time at bat. No attempt is made to actually strike the ball with a weight or "do-nut" in place.

Also attempts have been made to put attachments on bats to add weight distributed over the head region of the bat or its face. Examples of such devices are shown in:

U.S. Pat. No. 3,623,724 L. A. Landy Nov. 30, 1971

U.S. Pat. No. 3,833,217 D. F. Greaney Sep. 3, 1974

U.S. Pat. No. 3,944,225 D. F. Greaney Mar. 16, 1976

U.S. Pat. No. 5,024,436 S. J. Vento Jun. 18, 1991.

BRIEF DESCRIPTION OF THE INVENTION

Faced with the foregoing state of the art, it appeared to me that it should be possible to put a protective cover on a baseball bat used in practice in a manner that would not significantly change its weight, feel, or shape but protect the bat from developing the foregoing described problems. I found that I could use a thin natural rubber tube of 1/32" to 1/8" wall thickness when unstretched and the length in the order of 9 inches and a diameter of approximately 2/3 the diameter of the baseball bat head. I found that I could roll such a sleeve onto a bat beginning at its head and it was hardly noticeable since it changed the diameter of the bat and its weight insignificantly.

When used in practice, not only did the sleeve reduce the tendency of the batting surface to become worn, chipped, splinter, or split, but it reduced the sound of impact and reduced the vibration transmitted to the hands of the batter. This allowed him more practice with less tiring of the hands. Likewise, the barring coach can easily detect the sound of any hit outside of the intended contact zone since it will carry with it the classic metal or wood impact sound. A coach could therefore be observing one or more players while batting and audibly detect any major batting errors by other practicing batters. I have found that players do not object to the protective sleeve as affecting their batting and as I indicated above, actually favor the less shock to be transmitted to their hands allowing greater practice without tiring.

I found that a simple tube of uniform diameter is effective and owing to the bat contact zone shape, there is no tendency of the sleeve to slide off the bat in use. I have also learned, in the case of metal bats, with a plastic end, that it is desirable that the outer end of the sleeve cover the joint between the metal bat and the end plug. When so installed, the sleeve acts as a safety feature, as well, since end plugs commonly become loosened and fly out of the end of the bat. A slight overlapping of the sleeve over the end plug reduced the likelihood of presents that occurrence.

I have also found that it is possible to mold a rubber sleeve to cover the entire end cap with a somewhat smaller diameter toward the handle. Such an embodiment definitely prevents the end cap of the metal cap from departing the bat.

BRIEF DESCRIPTION OF THE DRAWING

This invention may be more clearly understood from the following detailed description and by reference to the drawing in which.

DETAILED DESCRIPTION OF THE INVENTION

Figure 1:
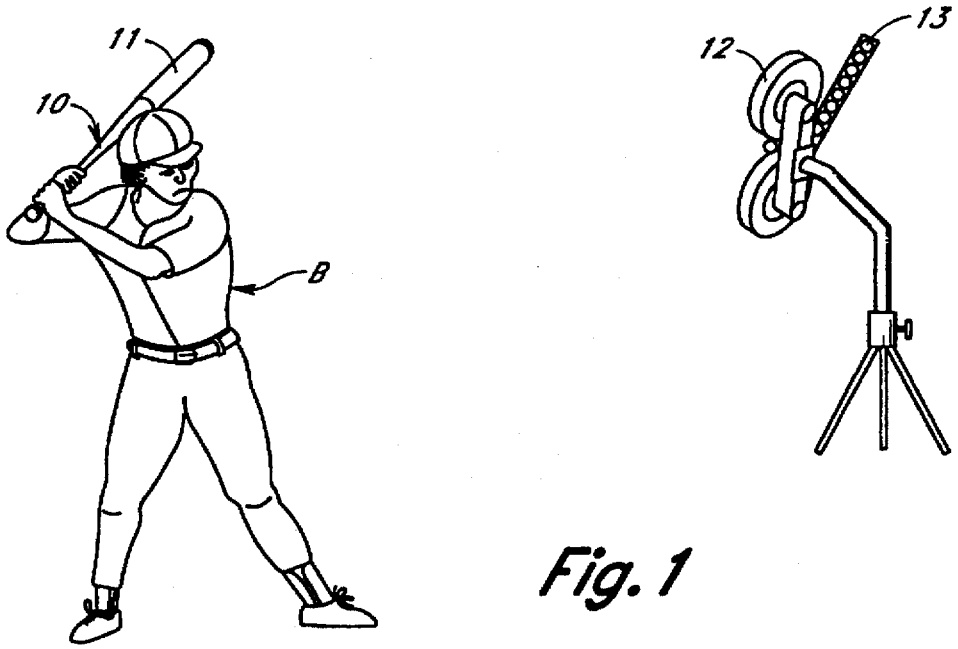
FIG. 1 is a prospective view of a batter employing this invention.

Now referring to FIGS. 1–4, this invention may be seen in use by a batter B with a bat 10 of his own selection and modified only in the presence of a sleeve or cover 11 extending over the contact zone of the bat. A batting machine 12 is positioned to deliver a series of baseballs 13. It is apparent in FIG. 1 and more particularly in FIG. 2 that the bat 10 is virtually unchanged in size and shape to the presence of the sleeve 11. Likewise, the weight of the bat is virtually unchanged. A typical bat used by professional players will range in weight from 29 to 36 ounces and the sleeve 11, which is preferably fabricated from a nine inch long tube of natural rubber of approximately one sixteenth inch wall thickness has a weight in the order of 2 to 3 ounces. Therefore, the sleeve 11 adds only 5–10% to the weight of the bat. This is considered insignificant.

Figure 2:
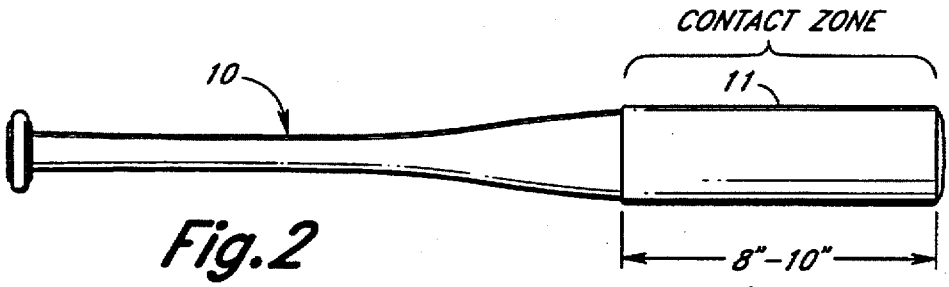
FIG. 2 is a side elevation view of a bat with this invention in place.
Figure 3:
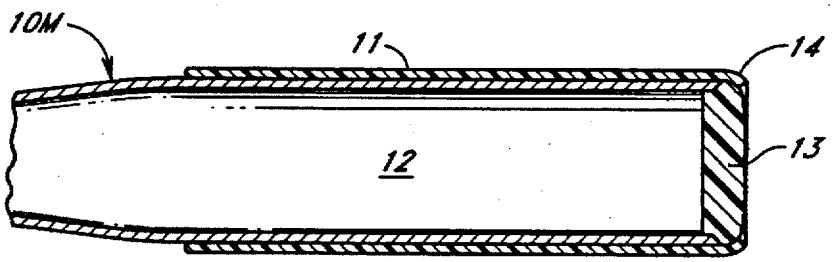
FIG. 3 is a fragmentary longitudinal sectional view of this invention applied to a hollow metal bat.

The natural resiliency of the sleeve 11 draws it tightly against the bat throughout the contact zone, which typically is in the order of 8–10 inches long. The bat 10 can be either a wooden or a hollow metal bat. As illustrated in FIG. 2, it can be either material. FIG. 3 shows the typical construction of the contact zone end of a metal bat 10M as being of aluminum or aluminum alloy with an internal hollow cavity 12 and an end plug 13 that is typically of plastic and secured by friction and/or adhesive at its end joint 14. Overlying the contact zone is the sleeve 11 of this invention. The natural resiliency of the stretched sleeve draws it tight against the cylindrical or tapered outer surface of the bat 10M. Note that in the preferred arrangement, the sleeve 11 extends beyond the joint 14 and partly covers the end plug. This is important in that the sleeve 11 provides further assurance that the end plug does not separate from the bat.

Figure 4:
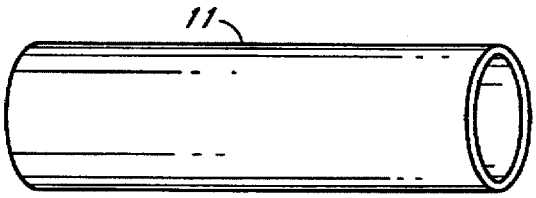
FIG. 4 is a perspective view of the tubular bat protector of this invention in its unstretched condition before placement on a bat.
Figure 5:
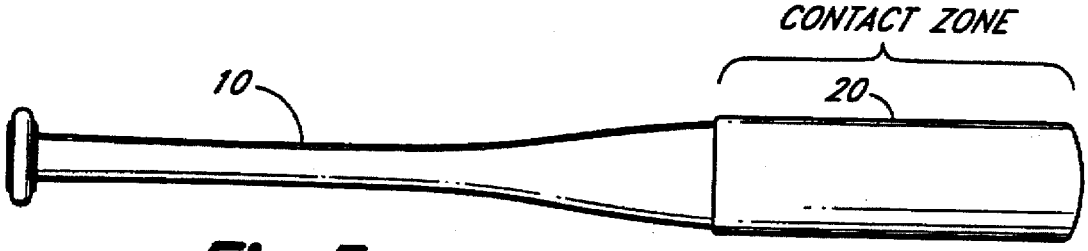
FIG. 5 is a side elevational view of a bat with an alternate embodiment of this invention.
Figure 6:
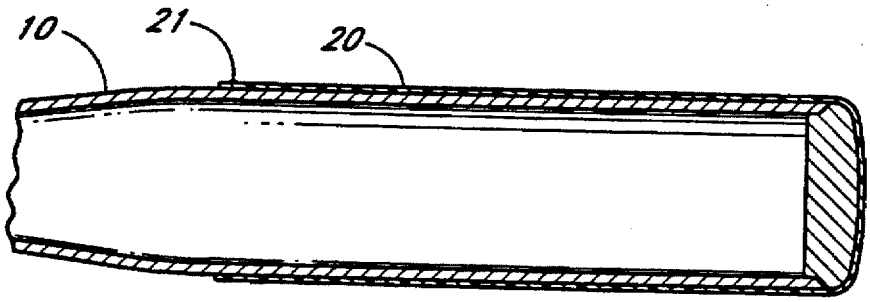
FIG. 6 is a fragmentary longitudinal sectional view of the bat of FIG. 5.

The sleeve 11 is shown in FIG. 4 as a uniform diameter rubber tube of length between 8 and 10 inches and a wall thickness in its unstretched condition of 0.0625 inch. The unrestrained inside diameter is in the order of 2 inches so that when stretched over a bat of 2¾ inch maximum legal diameter, the sleeve 11 is tightly secured to the bat and reduces its wall thickness by approximately 50%. This insures a tight fit and prevents any relative movement of the sleeve during practice to the batter there is virtually no effect upon the direction or distance of a hit ball in the presence of the sleeve 11. The sound or crack of the bat is definitely subdued thereby reducing the noise level in a batting cage where a number of batters are practicing at the same time.

The embodiment of FIG. 2–4 is preferred principally because the fact that it is totally effective, and a minimum cost, in as much as it uses only a length of tubing without any fabrication costs except cutting its to length. It may be rolled on from the end of the bat and therefore easily installed.

I have also found that someone more sophisticated, although more expensive version of this invention, is possible where the sleeve is molded in the form of a closed cup and molded in a variety of sizes related to the bat head diameter. Such an embodiment is shown in FIGS. 5–9. In that case, a closed cup cover 20 is shown on bat 10 in which the entire contact zone end of the bat is covered. This version has the principal advantage of positively insuring that the end cap 13 does not leave the bat in any normal usage.

The design of the FIGS. 5–9 has the additional advantage that it is possible to mold an annular ring 21 at the open end of the cup 20 at an additional strength and reducing the possibility of any tearing of the end as can occur if a ball repeatedly strikes the edge.

Figure 8:
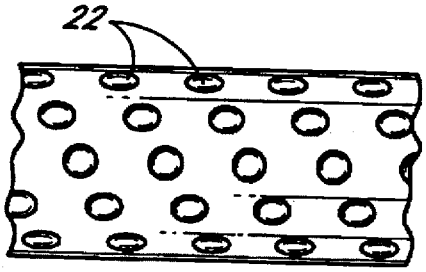
FIG. 7 and FIG. 8 are fragmentary side elevational views of alternate embodiments of this invention including surface embossments.
Figure 7:
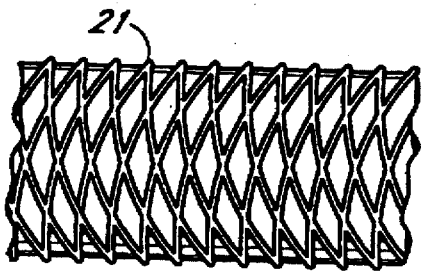

The molded version also gives the advantage of being able to add external embossments to the surface to enhance the frictional contact between the ball and the bat, if desired. In FIG. 7, the pattern, made up of a number of intersecting lines 21 forms a diamond pattern with raised ridges in the order of 1 1/16 inch. In the embodiment of FIG. 8, a number of circular embossments 22 are shown. This variation does slightly affect the contact with the ball but is only believed to improve the batter's performance. FIGS. 7 and 8 illustrate the added flexibility of the sleeve when molded.

The above described embodiments of the present invention are merely descriptive of its principals and are not to be considered limiting. The scope of the present invention, instead, shall be determined from the scope of the following claims including their equivalents.

What is claimed is:

1. A bat attachment, comprising:

a removable attachment having a length approximately equal to said length of a predetermined contact portion of a bat for playing baseball, said attachment comprising an elastic member defining an inner surface and an outer surface, said attachment extending circumferentially around said bat so as to be resiliently held in place, said attachment being positioned such that said inner surface is directly against said outer surface of said bat and said entire outer surface is exposed so as to be positioned to directly strike a ball, said attachment having an insignificant weight relative said bat and a thickness between 1/64 inch and 1/16 inch such that a difference in diameter between said outer surface of said attachment and said outer surface of said contact portion said bat is insignificant.

* * * * *